US010480394B2

(12) United States Patent
Shi et al.

(10) Patent No.: US 10,480,394 B2
(45) Date of Patent: Nov. 19, 2019

(54) SHROUD IN A HEAT EXCHANGE ASSEMBLY IN A VEHICLE

(71) Applicant: Ford Global Technologies LLC, Dearborn, MI (US)

(72) Inventors: Steven Shi, Nanjing (CN); Alvin Fei, Nanjing (CN); Castle Wen, Nanjing (CN)

(73) Assignee: Ford Global Technologies LLC, Dearborn, MI (US)

( * ) Notice: Subject to any disclaimer, the term of this patent is extended or adjusted under 35 U.S.C. 154(b) by 0 days.

(21) Appl. No.: 15/686,030

(22) Filed: Aug. 24, 2017

(65) Prior Publication Data

US 2018/0066569 A1 Mar. 8, 2018

(30) Foreign Application Priority Data

Sep. 5, 2016 (CN) ..... 2016 1 0804635

(51) Int. Cl.
*F01P 11/10* (2006.01)
*F01P 5/06* (2006.01)

(52) U.S. Cl.
CPC ..... *F01P 11/10* (2013.01); *F01P 5/06* (2013.01); *F01P 2070/50* (2013.01)

(58) Field of Classification Search
CPC .. F01P 5/06; F01P 11/10; B60K 11/06; B60K 11/04
USPC ..... 165/41, 44, 51, 122; 123/41.31, 41.58, 123/41.6, 41.61, 41.62
See application file for complete search history.

(56) References Cited

U.S. PATENT DOCUMENTS

| | | | | |
|---|---|---|---|---|
| 4,836,148 | A | 6/1989 | Savage et al. | |
| 6,106,228 | A * | 8/2000 | Bartlett | F01P 11/10 123/41.49 |
| 7,478,993 | B2 | 1/2009 | Hong et al. | |
| 7,603,968 | B2 * | 10/2009 | Pantow | B60K 11/02 123/41.04 |
| 8,128,358 | B2 * | 3/2012 | McLennan | B29C 45/14016 415/201 |
| 9,902,255 | B2 * | 2/2018 | Kim | B60K 11/02 |
| 2015/0118043 | A1 * | 4/2015 | Spaggiari | F01P 11/10 415/220 |

FOREIGN PATENT DOCUMENTS

| | | | |
|---|---|---|---|
| JP | 3539316 | B2 | 7/2004 |
| JP | 2010132182 | A * | 6/2010 |
| JP | 2010132182 | A | 6/2010 |
| KR | 100669917 | B1 | 1/2007 |

* cited by examiner

*Primary Examiner* — Leonard R Leo
(74) *Attorney, Agent, or Firm* — Geoffrey Brumbaugh; Kolitch Romano LLP

(57) ABSTRACT

A shroud in a heat exchange assembly of a vehicle comprises a housing connected with a radiator of the heat exchange assembly and spaced apart with the radiator; a ventilation aperture disposed on the housing and spaced apart from a fan receiving opening; and a flow guide structure having sidewalls and connected to the housing. The flow guide structure is configured to guide air flow from the ventilation aperture away from a clearance between the housing and the radiator.

16 Claims, 6 Drawing Sheets

SHROUD IN A HEAT EXCHANGE ASSEMBLY IN A VEHICLE

RELATED APPLICATION

This application claims the benefit of Chinese Patent Application No.: CN 201610804635.6 filed on Sep. 5, 2016, the entire contents thereof being incorporated herein by reference.

FIELD

This present application relates a shroud in a heat exchange assembly in a vehicle, in particular, relates to a shroud with a flow guide structure.

BACKGROUND

A vehicle typically includes a heat exchange assembly positioned at a front of an engine to cool the engine. The heat exchange assembly generally comprises a fan and a radiator. The fan is disposed on a shroud and the shroud is connected to the radiator. As shown in FIGS. 1A and 1B, the shroud S includes a plurality of ventilation apertures V and each ventilation aperture V includes a flap P. As shown in FIG. 1B, when the vehicle is traveling in a high speed, airflow F will go through the radiator R under the fan's suction, push the flap P open and then flow to the back of the fan. When the vehicle is idling, the flap P cannot be pushed open due to a small airflow F. Thus, the flap P prevents airflow to recirculate from the back of the fan to a clearance between the shroud S and the radiator R.

As the flap P is a single part independent from the shroud S, a cost of the shroud installed with the flap is high. However, if the flap is removed, the ventilation aperture V is open completely. When the vehicle is idling, airflow F will flow back from the backside of the fan to the clearance between the shroud S and radiator R as shown by arrow A in FIG. 1B and thus reducing the heat exchange efficiency.

SUMMARY

According to one aspect of the present disclosure, a shroud in a heat exchange assembly of a vehicle is provided. The shroud includes housing connected with a radiator of the heat exchange assembly and spaced apart with the radiator; a ventilation aperture disposed on the housing and spaced apart from a fan receiving opening in the housing; and a flow guide structure having sidewalls and connected to the housing. The flow guide structure is configured to guide airflow from the ventilation aperture away from a clearance between the housing and the radiator.

In one embodiment, the flow guide structure includes sidewalk extending from a front surface of the housing toward the radiator and surrounding entirely a perimeter of the ventilation aperture.

In another embodiment, one end of the sidewalk of the flow guide structure is connected to the front surface of the housing and another end of the sidewalls contact a surface of the radiator.

In another embodiment, the housing includes a sidewall disposed on an edge of the housing and extending at the same direction as the sidewalk of the flow guide structure.

In another embodiment, a height of the sidewalls of the flow guide structure protruded from a surface of the housing is at least the same as a height of the sidewall of the housing protruded from the surface of the housing.

In another embodiment, the flow guide structure is disposed on a rear surface of the housing away from the radiator and at least partially covers the ventilation aperture.

In another embodiment, the flow guide structure further includes a plurality of sidewall partially surrounding the ventilation aperture and a top wall connected to the sidewall and covering the ventilation aperture substantially. The sidewalls and the top wall form a cover structure with an air outlet communicating with the ventilation aperture.

In another embodiment, the ventilation aperture includes at least a first ventilation aperture and a second ventilation aperture, and an air outlet of the first ventilation aperture opens at a direction different from an air outlet of the second ventilation aperture.

In another embodiment, the ventilation aperture includes a plurality of ventilation apertures and a plurality of corresponding flow guide structures with air outlets, and each of the air outlet opens toward the fan receiving opening.

In another embodiment, the sidewalls include two sidewalls parallel each other and the two sidewalls having a triangle shape. One side of the top wall is connected with the rear surface of the housing and the top wall forms an angle with the rear surface of the housing.

In another embodiment, the sidewall includes a first sidewall and a second sidewall parallel each other, and a third sidewall opposite to the air outlet. The top wall is substantially parallel to the rear surface of the housing.

In another embodiment, the sidewall includes a first sidewall and a second sidewall parallel each other, and a third sidewall opposite to the air outlet. The top wall forms an angle with the rear surface of the housing and inclines up toward the air outlet.

In another embodiment, the sidewall and the top wall of the flow guide structure is integrally formed.

According to another aspect, a heat exchange assembly in a vehicle is provides. The heat exchange assembly comprises a radiator; a fan; and a shroud. The shroud includes a housing connected to the radiator and spaced apart from the radiator. The housing includes an assembling bracket and a fan receiving opening and the fan is mounted on the assembling bracket and received in the receiving opening. The housing further includes at least one ventilation aperture disposed on the housing and spaced apart from the fan receiving opening, and a first flow guide structure. The first flow guide structure is connected to the housing and surrounding the ventilation aperture, and the first guide structure includes sidewalls and is disposed on a front surface of the housing between the housing and the radiator.

In one embodiment, the first flow guide structure includes the sidewalls surrounding the ventilation aperture substantially and extending toward the radiator.

In another embodiment, the shroud further includes a second flow guide structure disposed on a rear surface of the housing away from the radiator and surrounding corresponding ventilation aperture. The second flow guide structure has the same structure as the first flow guide structure.

In another embodiment, the shroud further includes a second flow structure, disposed on a rear surface of the housing away from the radiator and includes a plurality of sidewall is partially surrounding the ventilation aperture and a top wall to form a cover structure with an air outlet communicating with a corresponding ventilation aperture. The second flow guide structure at least partially covers the ventilation aperture.

In another embodiment, each of the first and second flow guide structures are integrally formed and detachably connected with the housing.

In another embodiment, each of the first and second flow guide structures are integrally formed with the housing.

The shrouds of a heat exchange assembly according to the present invention have various advantages. For example, the flow guide structure includes sidewalls surrounding a ventilation aperture. As such, the air entering from the ventilation aperture passes through the guide tunnel formed by the flow guide structure toward the fan. When a vehicle is idling, the flow guide structure prevents the airflow recirculated to the clearance between the shroud and the radiator, thus to prevent the negative effect of the recirculated air flow on the heat exchange.

BRIEF DESCRIPTION OF THE DRAWINGS

Example embodiments will be more clearly understood from the following brief description taken conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed shrouds in a heat exchange assembly in a vehicle will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various shrouds of a heat exchange assembly are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 2A:
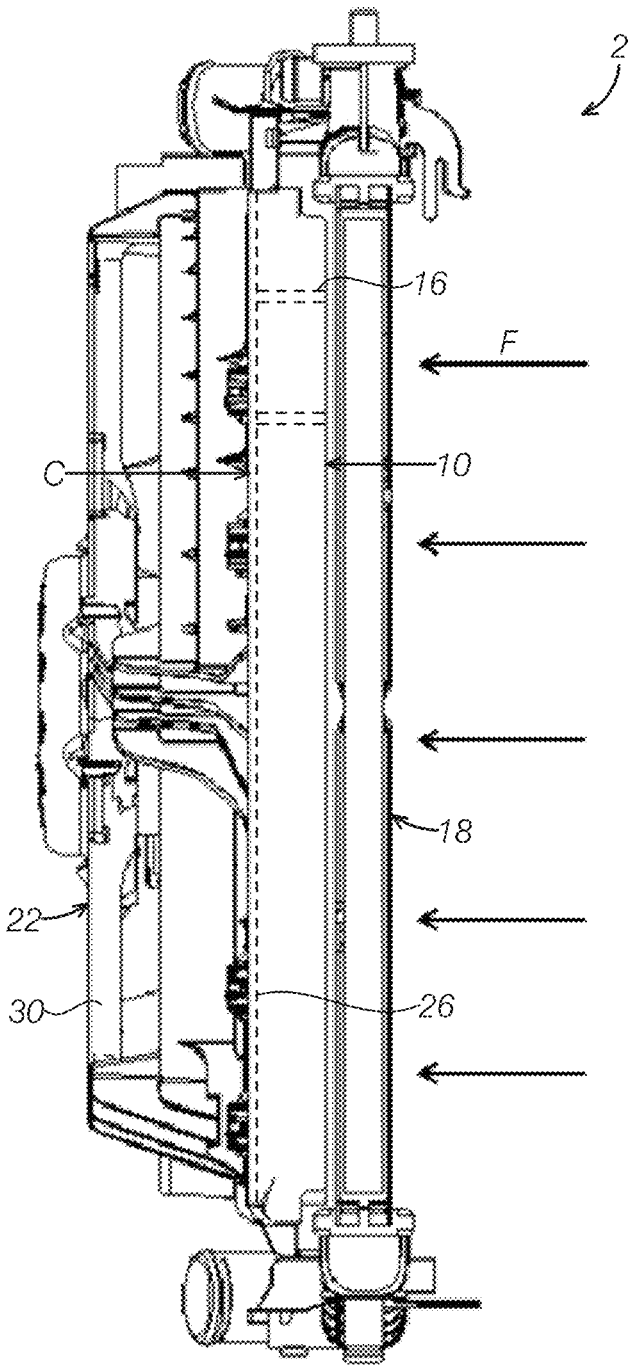
FIG. 2A is a side view of a heat exchange assembly according to one embodiment of the present disclosure.

FIG. 2A to 2D show a shroud 10 in a heat exchange assembly 2 of a vehicle according to one embodiment of the present disclosure. In some embodiments, the shroud 10 includes a housing 12, a plurality of ventilation apertures 14, a plurality flow guide structures 16 corresponding to the ventilation apertures 14. The housing 12 is connected to the radiator 18 and spaced apart from the radiator 18 as shown in FIG. 2A. The housing 12 further include a fan receiving opening 20 to hold a fan 22. Typically, the ventilation aperture 14 in the housing 12 is spaced apart from the fan receiving opening 20. In the depicted embodiment, the shroud 10 includes the flow guide structure 16 having sidewalk 24. The sidewalls 24 extend from a front surface 26 the housing 12 and surrounding the ventilation aperture 14 around its perimeter. The sidewalls 24 may be substantially perpendicular to or form an angle with the front surface 26 of the housing 12. The flow guide structure 16 is disposed between the housing 12 and the radiator R. In other words, the flow guide structure 16 is disposed on a front side of the housing 12 facing the radiator 18 as shown in FIG. 2A.

The sidewalls 24 of the flow guide structure 16 form a guide tunnel to the airflow entering the ventilation aperture 14. Thus, the air going through the radiator 18 passes the ventilation aperture 14 and flows to a backside of the fan at the guide of the sidewall 24. The air guide tunnel of the flow guide structure 16 can direct the airflow to go through a clearance C between the housing 12 and the radiator 18 directly, and block air outside the sidewall 24. When the vehicle is idling, the flow guide structure 16 only allows the airflow entering the ventilation aperture 14 pass the sidewall 24 and the air would not flow to the clearance C between the shroud 10 and the radiator 18 due to obstruction of the sidewall 24, and thus prevent recirculation of air to the shroud 10 to affect the heat exchange efficiency.

Figure 2B:
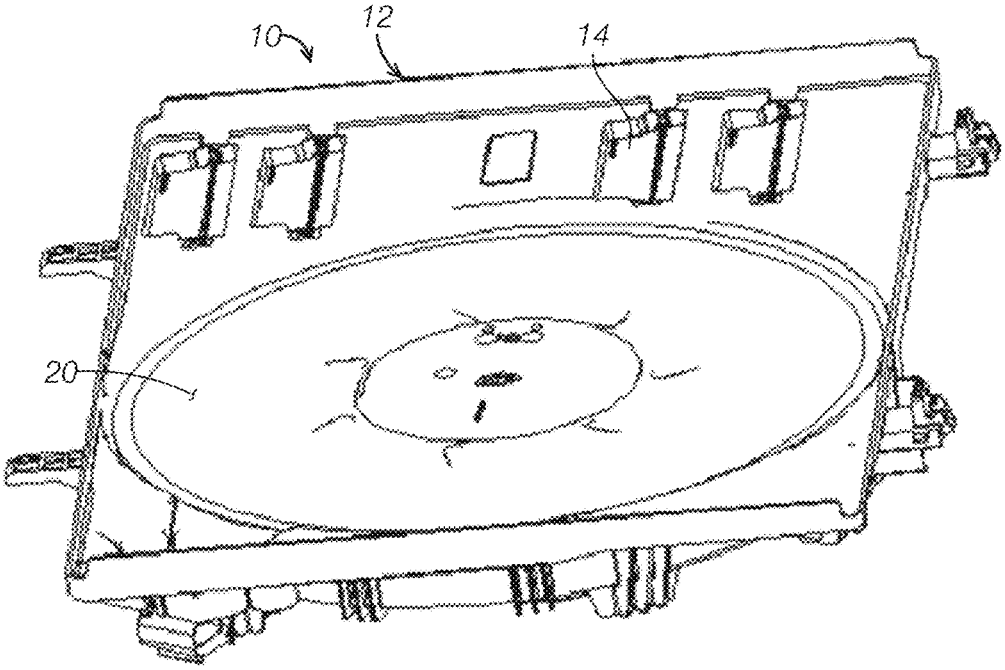
FIGS. 2B-2C are front views of a shroud in the heat exchange assembly in FIG. 2A.
Figure 2C:
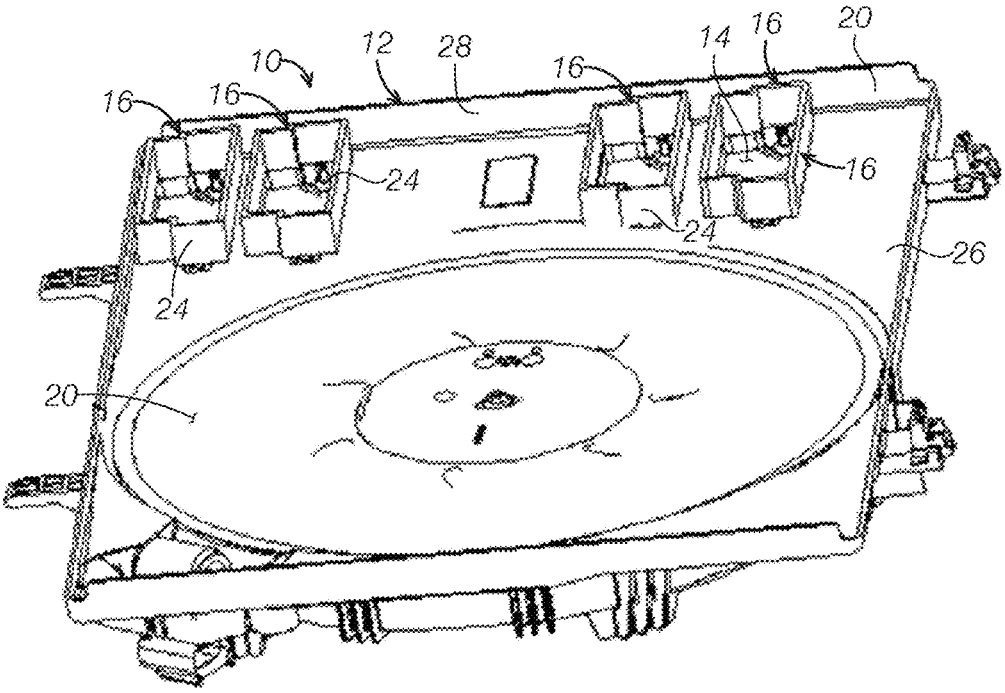
Figure 2D:
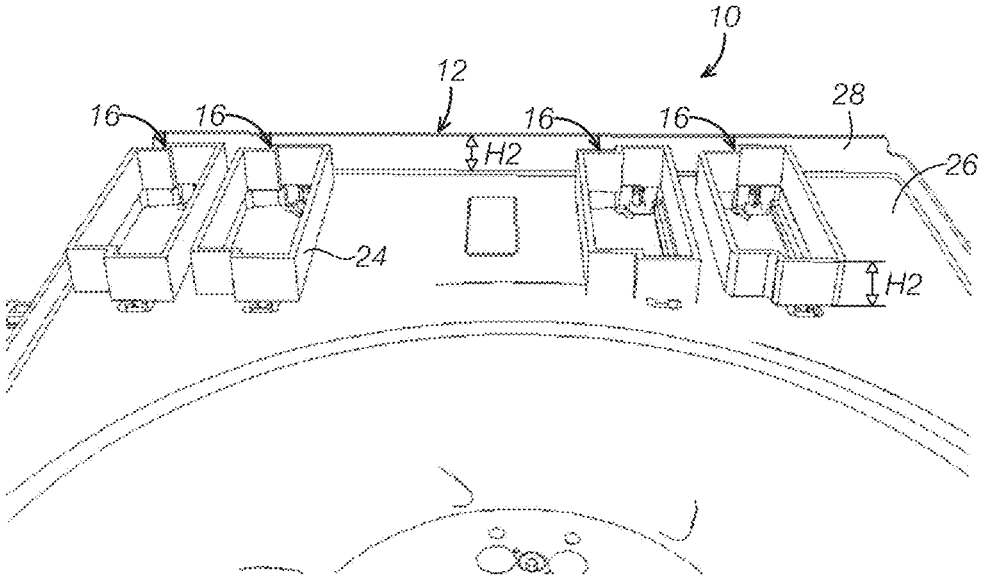
FIG. 2D is an enlarged partial view of shroud in FIGS. 2B-2C.

Referring to FIGS. 2C and 2D, in one embodiment, the sidewalls 24 surround the ventilation aperture 14 entirely and are positioned on the front surface 26 toward the radiator 18. That is, the sidewalls 24 are an enclosing structure surrounding the perimeter of the ventilation aperture 14 such that the airflow outside the sidewalk 24 cannot enter to the flow guide structure 16 and the air inside the region surrounded by the sidewalls 24 would not flow out to the clearance C. The flow guide structure 16 may be configured to be at the front surface 26 toward the radiator 18 to guide the air directly enter the guide channel formed by the sidewalls 24. In some embodiments, the sidewall 24 may be configured to protrude from the front surface 26 with an angle. In other embodiments, the sidewall 24 may be configured to protrude perpendicularly from the front surface 26 of the housing 12. When the front surface 26 of the housing 12 is parallel to a surface of the radiator, the sidewall 24 extends perpendicular to the surface of the radiator and the airflow can directly enter the guide tunnel formed by the sidewall 24. In the depicted embodiment, the cross section of the flow guide structure has a polygon shape. It should be appreciated that the cross section of the flow guide structure may have any appropriated shape such as a circular or oval shape.

In one embodiment, one end of the sidewall 24 is connected to the housing 12 with any appropriate connection, such as clip or fastener and another end of the sidewall 24 may contact a surface of the radiator 18. When the end of the sidewall 24 contacts the surface of the radiator, the clearance C between the housing 12 and the radiator can be further enclosed, thus, the air enters substantially via the guide channel formed by the sidewall 24.

The housing 12 may include a plurality of ventilation apertures 14 and a plurality of corresponding flow guide structures. While FIGS. 2B-2D shows that the housing 12 includes four ventilation apertures 14 and four flow guide structure 16, it should be appreciated that the housing may include any appropriate number of the ventilation apertures and the flow guide structures.

Continuing FIGS. 2C and 2D, in one embodiment, the housing 12 includes a sidewall 28 disposed at an edge of the housing 12 and extending at the same direction as the sidewall 24. In some embodiments, a height of the sidewall 24 is at least the same as a height H2 of the sidewall 28 of the housing 12. In other words, the height H1 of the flow guide structure 16 is at least same height H2 of the sidewall 28 of the housing 12. The sidewall 28 of the housing functions to block some recirculated air and prevent it to recirculate to the clearance C between the housing 12 and radiator 18. When the height of the flow guide structure 16 equals or greater than the height of the sidewall 28 of housing 12, it is effective to block the flow to recirculated.

Figure 3A:
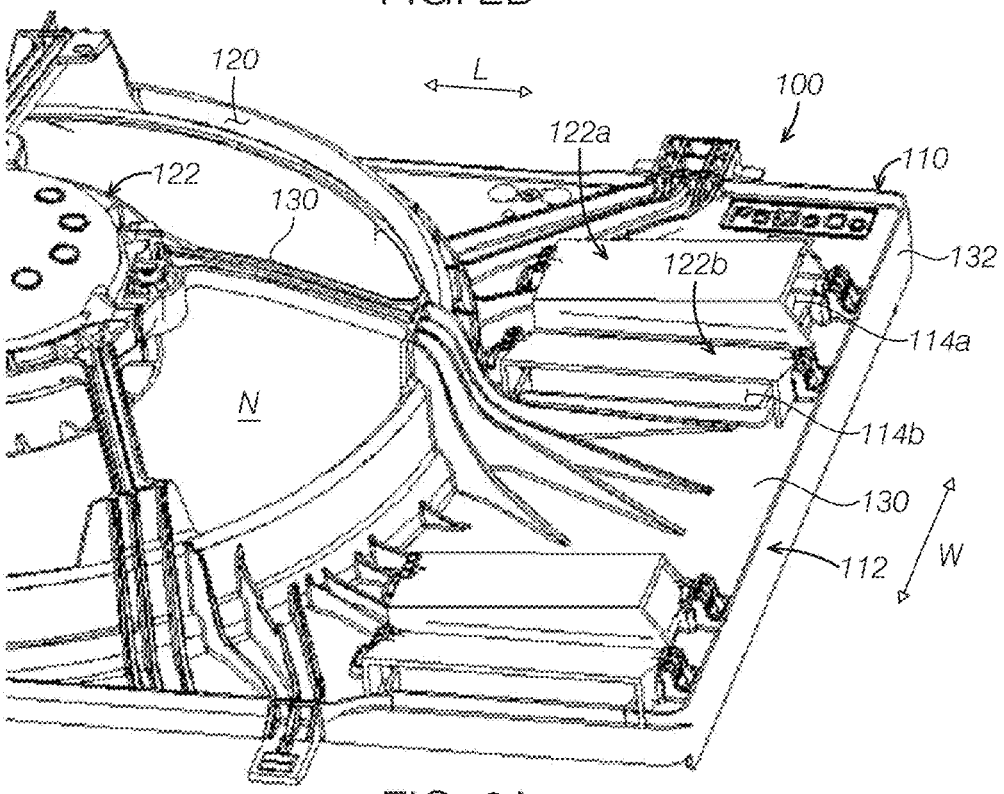
FIG. 3A are perspective view of a shroud according to another embodiment of the present disclosure as viewed from a back side of the shroud.
Figure 3B:
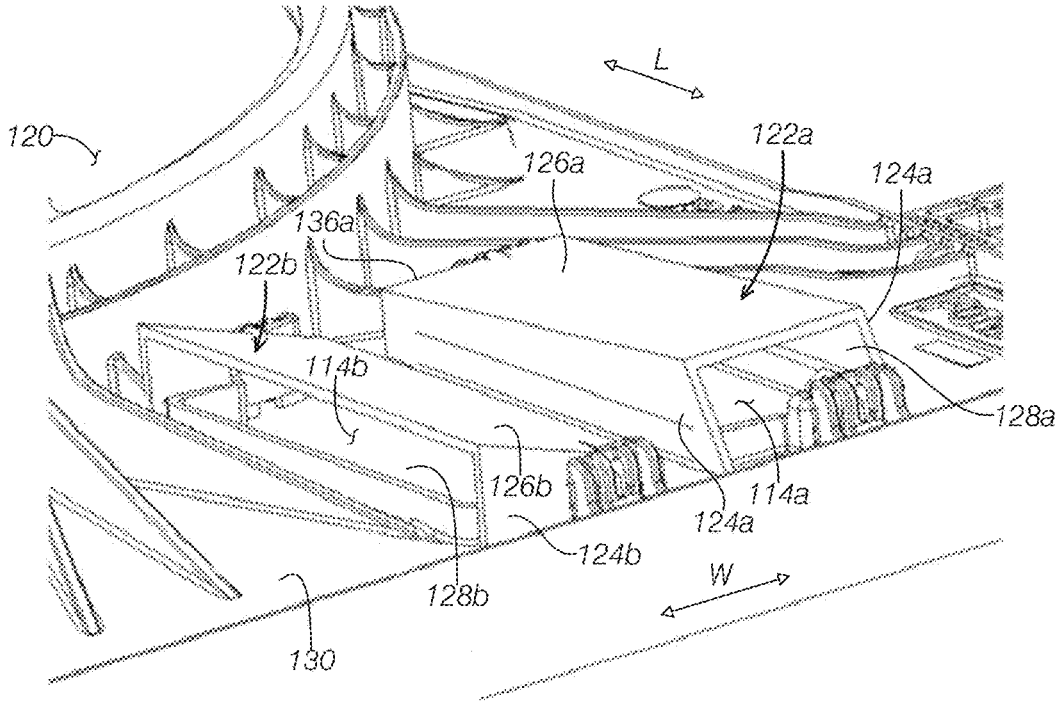
FIGS. 3B-3C are enlarged partial view of the shroud in FIG. 3A.
Figure 3C:
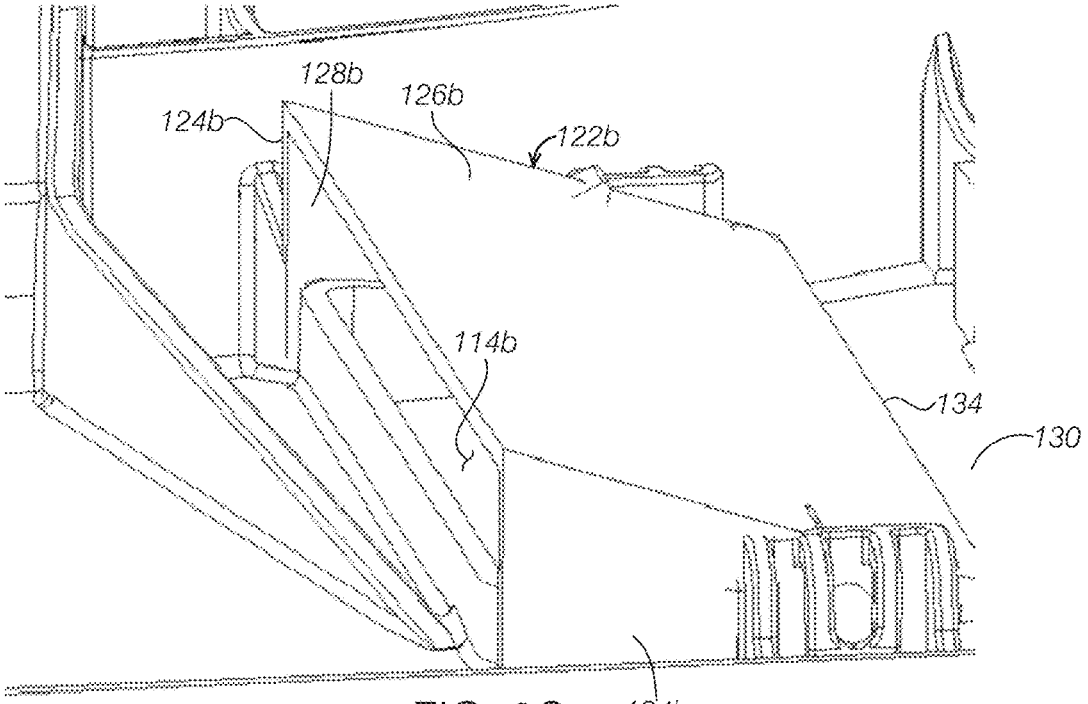

Referring to FIGS. 3A to 3C, a heat exchange assembly 100 according to another embodiment of the present invention is illustrated. The heat exchange assembly 100 includes a radiator (not shown), a shroud 110 and a fan 122 disposed on the shroud 110. The shroud 110 includes a housing 112, a plurality of ventilation apertures 114*a*, 114*b*, and a plurality of flow guide structures 122*a*, 112*b*. The housing 112 may include sidewalk 132 extends substantially perpendicular from a rear surface 130 of the housing. The position and the structure of the flow guide structure 122*a*, 122*b* are different from the flow guide structure 22 in the embodiment illustrated in FIGS. 2A-2D.

The housing 112 may be connected to the radiator of the heat exchange assembly and spaced apart from the radiator. The ventilation aperture 114 is disposed on the housing 112 and spaced apart from a fan receiving opening 120. The flow guide structures 122*a*, 122*b* are connected to the housing 112 and surrounding the ventilation aperture 114. In the depicted embodiment, the flow guide structure 122*a*, 122*b* are disposed on the rear surface 130 of the housing 112 which is on a rear side opposite to or away from the radiator. The flow guide structure 122*a*, 122*b* at least partially covers the ventilation apertures 114*a*, 114*b*, respectively.

In the depicted embodiment, the flow structure 122*a*, 122*b* are formed on the rear surface 130 of the housing 112. The flow guide structures 122*a*, 122*b* surround and cover the ventilation apertures 114*a*, 114*b*, respectively. Thus, the flow guide structure 122*a*, 122*b* can guide the airflow through the ventilation apertures 114*a*, 114*b* to make the air flow away from the clearance between the shroud and the housing to prevent decreased heat exchange efficiency due to the recirculated airflow.

Referring to 3A to 3C, FIGS. 3B-3C are enlarged partial diagrams of the shroud 110 in FIG. 3A. The sidewall 124*a* of the flow guide structure 122*a* partially surrounds ventilation aperture 114*a*, and the top wall 126*a* connects the sidewall 124*a* and covers the ventilation aperture 114*a*. The sidewall 124*a* and the top wall 126*a* together form a cover structure with an air outlet 128*a* communicating with the ventilation aperture 114*a*. In other words, the air outlet 128*a* communicates with the ventilation aperture 114*a* via the cover structure formed by the sidewall 124*a* and the top wall 126*a* to guide the airflow from the ventilation aperture 114*a* to the air outlet 128*a*, and discharge from the air outlet 128.

Similarly, the flow guide structure 122*b* includes sidewalk 124*b* and the top wall 126*b* which form a guide tunnel with an air outlet 128*b*. The first air outlet 128*a* and the second air outlet 128*b* open at different directions. For example, the air may flow out from the first air outlet 128*a* at a lengthwise direction L and the air may flow out from the second air outlet 128*b* at a widthwise direction W to guide the airflow to different directions. In the embodiment shown in FIG. 3B, for example, the air outlet 128*a* opens toward to a right (i.e., at the lengthwise direction L away from the fan receiving opening 120, and the air outlet 128*b* opens at downward direction. In some embodiments, the shroud 110 may include multiple flow guide structures having the air outlets opening toward a left or opening upward (not shown). It should be understood that the housing may include any appropriate number of ventilation apertures (e.g., four ventilation apertures as shown in FIG. 3A) and corresponding flow guide structures.

In some embodiments, all air outlets may be configured to open toward to the fan receiving opening (not shown). When the air outlets open toward to the fan receiving opening, the flow direction of the air outlet is away from the sidewall of the housing 12, which is also effective in preventing the air recirculated to the radiator when the vehicle is idling.

In one embodiment shown in 3C, the second flow guide structure 122*b* includes a top wall 126*b* with one side 134 connected with the rear surface 130 of the housing 12. The top wall 126 forms an angle with the rear surface 130. The second flow guide structure 122*b* further includes two parallel side walls 124*b* having a triangle shape. The top wall 126*b* connects with both the side walls 124*b* and the housing 12 to form a cover structure with the air outlet 128*b*. The sloped top wall 126*b* can facilitate the airflow from the ventilation aperture 114*b*.

In one embodiment as shown in FIGS. 3A and 3B, the first flow guide structure includes a top wall 126*a*, a first sidewall and a second sidewall 124*a* parallel each other and a third sidewall 136*a* facing the air outlet 128*a*, each of the first, second and a third sidewalls 124*b* may have a quadrilateral shape. The top wall 126*a* is disposed on the first, second and third sidewalls 124*a*, 136*b*. The top wall 126*b* may be substantially parallel to the rear surface 130 of the housing 112 or may be inclined upward to the air outlet 128*a*.

In some embodiments, the sidewall 124*a* and the top wall 126*a* of flow guide structure 122*a* may be integrally formed. Similarly, the sidewall 124*b* and the top wall 126*b* of flow guide structure 122*b* may be integrally formed. In some embodiment, the flow guide structure may further be integrally formed with the housing.

According to another aspect of the present disclosure, a heat exchange assembly in a vehicle is provided. The heat exchange assembly comprises a radiator, a shroud and a fan. It should be understood that the embodiment shown in FIGS. 2A to 2D and FIGS. 3A to 3C may be combined to constitute other embodiments, and the various parts described above may be included the in the heat exchange assemble.

Referring to 2A to D, the shroud 10 of the heat exchange assembly 2 includes a housing 12, at least one ventilation aperture 14, and a first flow guide structure 16. The housing 12 connects with a radiator and spaced apart from the radiator 18. The housing 12 includes a bracket 30 and a fan receiving opening 20, and the fan 22 is disposed on the bracket 30 and received in the fan receiving opening 20. As shown in FIG. 2A to 2D, the ventilation aperture 14 is disposed on the housing 12 and is spaced apart from the fan receiving opening 20. The flow guide structure 16 is connected to the housing 12 and include sidewalls 24 surrounding the ventilation aperture 14, and the first flow guide structure 16 is disposed between the housing 12 the radiator 18. In some embodiments, the first flow structure 16 surrounds entirely the perimeter of the ventilation aperture 14 and extends toward a surface of the radiator 18.

In some embodiments as 3A to 3C, the shroud 110 of a heat exchange assembly 100 includes a second flow guide structure 122. The flow guide structure 122 is disposed on a back side of the housing 112 away from the radiator and surrounds the ventilation aperture 114.

In some embodiments, the first flow guide structure 16 is disposed on a front surface (toward to radiator side), and the second flow structure 122 is disposed on a rear surface of the housing 12 opposite to the front surface (away from the radiator). In other words, two types of the flow guide structure may be disposed on the different sides of the housing of heat exchange assembly.

In some embodiments, the flow guide structure with the same configuration may be disposed on the front side and the back side of the housing. For example, first flow guide structure 16 as described in association with the FIGS. 2A-2D may be disposed on both front side and back side of the housing 12.

When the second flow guide structure 122 is disposed on the backside of the housing 118, the second flow guide structure 122 includes a sidewall 124 partially surrounding the ventilation aperture 114 and a top wall 126 connected to the sidewall 124 and covering the ventilation aperture 114 substantially, and the sidewall 124 and the top wall 126 form a guide tunnel with an air outlet 128 communicating with the ventilation aperture 114.

Figure 1A:
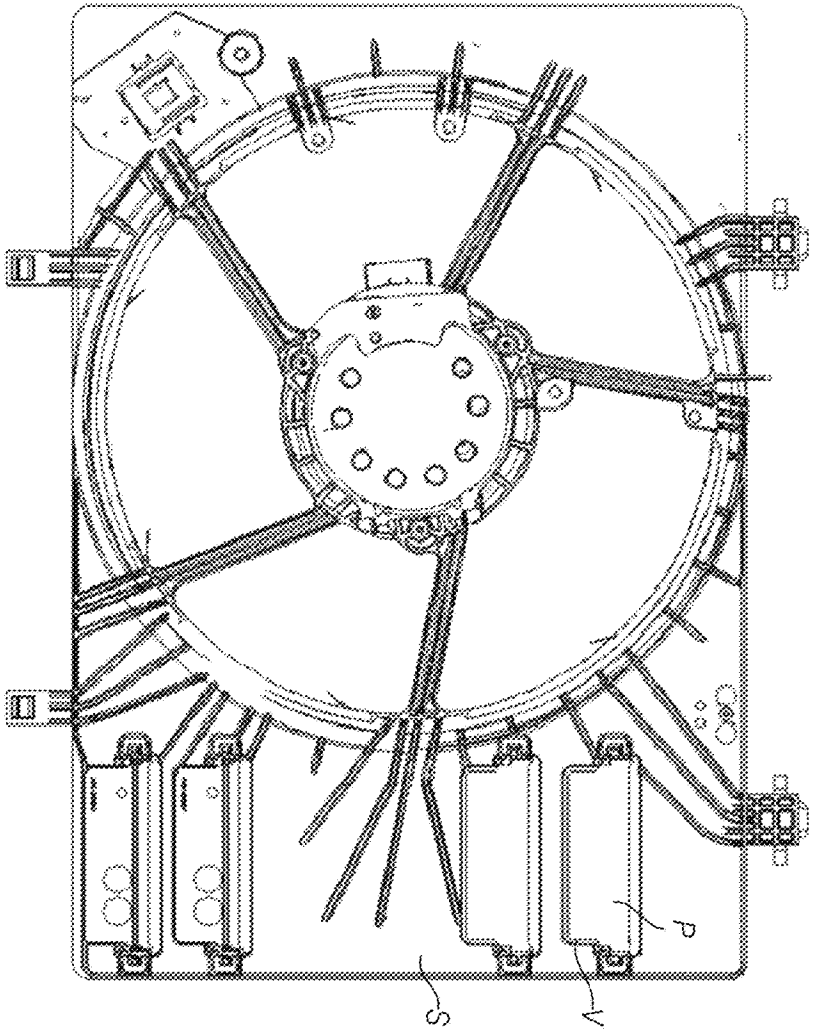
FIG. 1A PRIOR ART
FIGS. 1A and 1B are schematic diagrams of a heat exchange assembly of prior art.
Figure 1B:
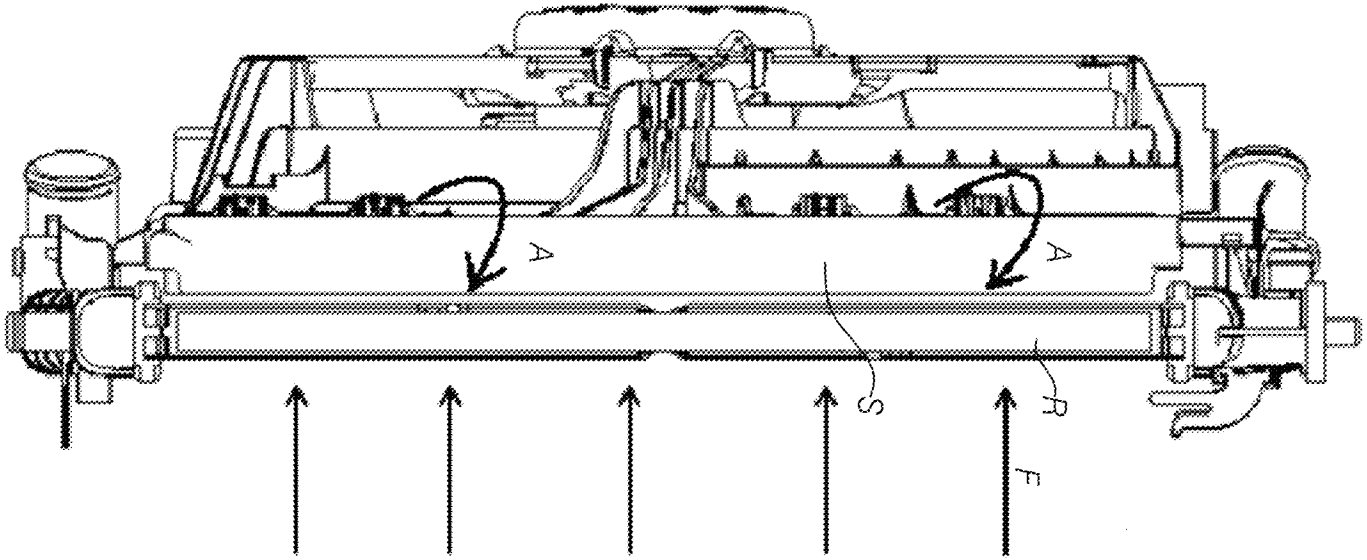
FIG. 1B PRIOR ART

In some embodiments, the first flow guide structure 16 and second flow guide structure 122 are integrally formed with the housing. In other embodiments, the first flow guide structure 16 and second flow guide structure 122 may be detachably connected with the housing 12 such that the first flow guide structure 16 and second flow guide structure 122 may be assembled on some conventional shrouds to replace the flap P as shown in FIG. 1A.

In some embodiments, the shroud includes the first flow guide structure and the second flow guide structing on the frontside and backside of the shroud, respectively. The first flow guide structure may include sidewalls that forms a guide tunnel which separate the incoming airflow with the clearance between shroud and the radiator. The second flow guide structure may include sidewalls and a top wall to form a cover structure and may be disposed on the backside of the shroud to guide the airflow and prevent airflow recirculate to the clearance between the shroud and the radiator. In some embodiments, the shroud may include both the first and second flow guide structures to improve heat exchange efficiency.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

The following claims particularly point out certain combinations and subcombinations regarded as novel and non-obvious. These claims may refer to "an" element or "a first" element or the equivalent thereof. Such claims should be understood to include incorporation of one or more such elements, neither requiting nor excluding two or more such elements. Other combinations and subcombinations of the disclosed features, functions, elements, and/or properties may be claimed through amendment of the present claims or through presentation of new claims in this or a related application.

The invention claimed is:

1. A heat exchange assembly of a vehicle, comprising:
a radiator; and
a shroud including:
a housing adapted to be connected with the radiator of the heat exchange assembly and spaced apart with the radiator, wherein the housing includes a fan receiving opening;
a ventilation aperture disposed on the housing and spaced apart from the fan receiving opening; and
a flow guide structure having sidewalls and connected to the housing, wherein the sidewalls form a guide tunnel to airflow entering the ventilation aperture and are configured to guide the airflow away from a clearance between the housing and the radiator and the ventilation aperture remains open all time;
wherein the sidewalls of the flow guide structure extend from a front surface of the housing toward the radiator and surrounding entirely a perimeter of the ventilation aperture; and
wherein one end of the sidewalls of the flow guide structure is connected to the front surface of the housing and another end of the sidewalls contacts a surface of the radiator.

2. The heat exchange assembly of claim 1, wherein the housing includes a sidewall disposed on an edge of the housing and extending at the same direction as the sidewalls of the flow guide structure.

3. The heat exchange assembly of claim 2, wherein a height of the sidewalls of the flow guide structure protruded from the front surface of the housing is at least the same as a height of the sidewall of the housing protruded from the front surface of the housing.

4. The heat exchange assembly of claim 1, wherein the flow guide structure is disposed on a rear surface of the housing away from the radiator and at least partially covers the ventilation aperture.

5. The heat exchange assembly of claim 4, wherein the flow guide structure further includes a plurality of sidewalls partially surrounding the ventilation aperture and a top wall connected to the sidewall and covering the ventilation aperture substantially, and wherein the sidewalls and the top wall form a cover structure with an air outlet communicating with the ventilation aperture.

6. The heat exchange assembly of claim 5, wherein the ventilation aperture includes at least a first ventilation aperture and a second ventilation aperture, and wherein an air outlet of the first ventilation aperture opens at a direction different from an air outlet of the second ventilation aperture.

7. The heat exchange assembly of claim 5, wherein the ventilation aperture includes a plurality of ventilation apertures and a plurality of corresponding flow guide structures with air outlets, and wherein each of the air outlets open toward the fan receiving opening.

8. The heat exchange assembly of claim 5, wherein the sidewalls include two sidewalls parallel to each other and the two sidewalls having a triangle shape, wherein one side of the top wall is connected with the rear surface of the housing and wherein the top wall forms an angle with the rear surface of the housing.

9. The heat exchange assembly of claim 5, wherein the sidewall includes a first sidewall and a second sidewall parallel to each other, and a third sidewall opposite to the air outlet, and wherein the top wall is substantially parallel to the rear surface of the housing.

10. The heat exchange assembly of claim 5, wherein the sidewall includes a first sidewall and a second sidewall parallel to each other, and a third sidewall opposite to the air outlet, and wherein the top wall forms an angle with the rear surface of the housing and inclines up toward the air outlet.

11. The heat exchange assembly of claim 5, wherein the sidewall and the top wall of the flow guide structure is integrally formed.

12. A heat exchange assembly in a vehicle, comprising:

a radiator;

a fan; and a shroud including:

a housing, wherein the housing is connected to the radiator and spaced apart from the radiator, and wherein the housing includes an assembling bracket and a fan receiving opening and the fan is mounted on the assembling bracket and received in the receiving opening, at least one ventilation aperture disposed on the housing and spaced apart from the fan receiving opening, and a first flow guide structure, wherein the first flow guide structure is connected to the housing and surrounding a ventilation aperture, and wherein the first flow guide structure includes sidewalls and is disposed on a front surface of the housing between the housing and the radiator, and wherein the first flow guide structure is configured to guide airflow through a guide tunnel formed by the sidewalls while the ventilation aperture opens regardless of a vehicle speed;

wherein the first flow guide structure includes the sidewalls surrounding the ventilation aperture substantially and extending toward the radiator; and wherein one end of the sidewalls of the first flow guide structure is connected to the front surface of the housing and another end of the sidewalls contact a surface of the radiator.

13. The heat exchange assembly of claim 12, wherein the shroud further includes a second flow guide structure, wherein the second flow guide structure is disposed on a rear surface of the housing away from the radiator and surrounds corresponding ventilation aperture, and wherein the second flow guide structure has the same structure as the first flow guide structure.

14. The heat exchange assembly of claim 13, wherein each of the first and second flow guide structures is integrally formed and detachably connected with the housing.

15. The heat exchange assembly of claim 13, wherein each of the first and second flow guide structures is integrally formed with the housing.

16. The heat exchange assembly of claim 12, wherein the shroud further includes a second flow structure, wherein the second flow structure is disposed on a rear surface of the housing away from the radiator and includes a plurality of sidewalls partially surrounding the ventilation aperture and a top wall to form a cover structure with an air outlet communicating with a corresponding ventilation aperture, and wherein the second flow guide structure at least partially covers the ventilation aperture.

* * * * *